United States Patent [19]

Lazar

[11] Patent Number: 4,968,203

[45] Date of Patent: Nov. 6, 1990

[54] METHOD AND APPARATUS FOR MAKING BOOK-BINDINGS

[76] Inventor: Peter Lazar, Tannenstr. 11, D-4040 Neuss 21, Fed. Rep. of Germany

[21] Appl. No.: 401,246

[22] Filed: Aug. 31, 1989

[30] Foreign Application Priority Data

Sep. 3, 1988 [DE] Fed. Rep. of Germany ..... 3829977

[51] Int. Cl.[5] ..... B42D 7/00

[52] U.S. Cl. ..... 412/3; 412/1; 412/8; 412/902; 281/21.1

[58] Field of Search ..... 412/3, 17, 37, 900, 412/1, 8, 11, 902; 156/500, 245, 230, 232; 281/21.1

[56] References Cited

U.S. PATENT DOCUMENTS

| | | | |
|---|---|---|---|
| 3,137,874 | 6/1964 | Hildmann et al. | 412/3 |
| 3,531,358 | 9/1970 | Rost et al. | 412/37 |
| 3,532,363 | 10/1970 | Abildgaard et al. . | |
| 3,707,418 | 12/1972 | Bhagat et al. | 412/37 |
| 4,289,330 | 9/1981 | Wiermanski | 412/900 |
| 4,367,061 | 1/1983 | Wilholm | 412/3 |
| 4,606,689 | 8/1986 | Wilholm | 412/3 |
| 4,718,796 | 1/1988 | Lazar | 412/3 |
| 4,898,506 | 2/1990 | Lazar | 412/8 |

FOREIGN PATENT DOCUMENTS 3010642 10/1980 Fed. Rep. of Germany .

*Primary Examiner*—Douglas D. Watts
*Assistant Examiner*—Thomas Hamill, Jr.
*Attorney, Agent, or Firm*—Shlesinger & Myers

[57] ABSTRACT

The present invention is directed to a method and apparatus for making book bindings. In one of the preferred embodiments the method includes the steps of initially aligning a hot-melt adhesive strip on a base; aligning a sheet of material relative to the hot-melt adhesive strip; pressing a first time the sheet of material onto a strip of hot-melt adhesive for bonding the strip of hot-melt adhesive to the sheet of material without forming folding lines therein; pressing a second time the sheet of material against at least one associated bending edge adjacent at least one longitudinal side of the hot-melt adhesive strip thereby forming at least one fold line in the sheet of material, maintaining the sheet of material in the initially aligned position during the first and second pressing steps; and lifting the sheet of material following the first pressing step and prior to the second pressing step by moving the at least one associated bending edge to a position below an anticipated position of the at least one fold line thereby lifting the hot-melt adhesive off the base.

18 Claims, 2 Drawing Sheets

METHOD AND APPARATUS FOR MAKING BOOK-BINDINGS

The invention concerns a method for making book-bindings or the like from a sheet of material and from a hot-melt strip, with the following features:

(a) The hot-melt strip is aligned on a substrate, (b) The sheet of material is aligned with the hot-melt strip and deposited on it, (c) The sheet of material is pressed onto the hot-melt strip to bond with it, (d) At least one fold line is formed, by pressing against one bending edge, into the sheet of material in the vicinity of at least one longitudinal side of the hot-melt strip.

Moreover the invention concerns apparatus for making a book-binding or the like and comprising the following features:

(a) The apparatus comprises a substrate with aligning means for a hot-melt strip, (b) The apparatus includes an aligning device to align a sheet of material relative to the substrate, (c) At least one folding edge is provided to shape a folded line into the material sheet along the hot-melt strip, (d) A compression block to press the sheet of material toward the substrate is provided opposite this substrate.

Such method and apparatus are already known from the German Offenlegungsschrift No. 30 10 642. In this method a hot-melt strip previously cut to size off rolls or sheets is deposited on a substrate bounded by two raised bending edges spaced suitably apart. The bending edges are in the form of flats and simultaneously serve to align the hot-melt strip. Next a sheet of material is superposed in such a manner that the area that shall form the binding-back is placed above the hot-melt strip. The sheet of material then is pressed by a compression block or roll against the bending strips and the hot-melt strip. Not only is the sheet of material bonded thereby to the hot-melt strip, but also the folds to bend the binding covers toward the binding back are formed simultaneously by means of the bending flats.

This method incurs substantial drawbacks. A fairly high pressure is required to simultaneously fasten the hot-melt strip and to form the fold lines, and that pressure must be applied by the compression block. Because as a rule heat is applied at the same time, the hot-melt strip tends to stick to the substrate and/or to the bending flats. This makes it more difficult to remove the sheet of material following compression. Also there is substantial danger that the hot-melt strip, still being pasty, shall shift when the sheet of material is being removed. On account of the compression block, the sheet of material moreover can be removed only obliquely, thereby favoring shifting the hot-melt strip.

Another drawback of this apparatus is that the bending strips simultaneously form the lateral boundaries of the substrate for the hot-melt strip. Thereby the fold lines often are formed directly next to the hot-melt strip. Frequently however this will be undesirable.

Based on the method and apparatus of the initially cited kind, the object of the invention is to create a method for making book-bindings in problem-free manner and thereby assuring higher binding quality and moreover more latitude in placing the folding lines. Another object is creating apparatus with which to carry out the said method.

This problem is solved by the invention by a method characterized as follows:

(e) the fold line(s) is (are) formed only after the hot-melt strip is bonded to the sheet of material in that (aa) the folding edge(s) following the first compression step are (is) moved underneath the sheet of material until being in a position below the anticipated fold line, (bb) thereby the sheet of material is lifted until the hot-melt strip is raised off the substrate, (cc) the sheet of material then is pressed in a second compression step against the bending edge(s).

In the method of the invention therefore the bonding between the hot-melt strip and the sheet of material on one hand and the formation of the fold line on the other are implemented by two sequential compression steps, the sheet of material together with the hot-melt strip being lifted prior to the second compression, namely by the bending edges initially outside the compression zone and being moved in the interval between the two compression steps into the position(s) provided to form the fold lines and thereby simultaneously lifting the sheet(s) of material. Even though this method contrary to the previously known procedures is in two stages, it does offer substantial advantages more than compensating the two-stage drawback. Illustratively the lifting of the sheet of material by moving the bending edge(s below is in a manner substantially more uniform and reproducible than possible by hand. Accordingly, the hot-melt strip may be removed in substantially improved manner. Another advantage is that the bending edge(s) when being moved underneath the sheet of material can be positioned at will, that is, the fold lines can be placed with much latitude. They may be present where particular advantageous to fold the binding.

Moreover the method of the invention now makes it possible to match the pressure in the two compression steps to the particular requirements. Indeed only slight pressure is required to bond the hot-melt strip to the sheet of material. When such pressure is applied, the tendency to stick is reduced further and accordingly lifting the sheet of material by means of the bending edge(s) takes place in wholly problem-free manner. Thereupon higher pressure may be provided to form the folding lines by means of the second compression step to ensure optimal formation of the fold lines. Because the bending edge(s) are (is) retracted following the second compression step, the hot-melt strip is no longer framed by them (it) and thereby the sheet of material may be removed in problem-free manner, without danger of shifting the hot-melt strip. A high-quality book-binding is achieved, with reliably reproducible quality.

In a further embodiment of the invention, the bending edge(s) initially support(s) the sheet of material outside the compression zone until it (they) is (are) moved into the position(s) provided for making the fold lines. In this manner the motion of the bending edge(s) into the fold line position will not raise problems.

Apparatus of the invention to make the book-binding evinces the following features:

(e) The bending edge(s) is (are) removable from the effective range of the compression block when the hot-melt strip and the sheet of material are bonded together, (f) To form the fold line(s), the bending edge(s) is (are) displaceable from the position outside the effective range of the compression block into a position underneath the anticipated fold line, (g) The bending edge(s) project(s) so much that the sheet of material together with the hot-melt strip is lifted into the effective range of the block upon motion of the bending edge(s).

This apparatus allows carrying out the method of the invention and thereupon the above cited advantages shall be realized. It is especially advantageous to provide a pressure control system for said apparatus to lower the compression when bonding the hot-melt strip to the sheet of material and to raise the compression when forming the fold lines.

In one embodiment mode of the invention, it is proposed that a first compression block be provided for the bonding of the hot-melt strip to the sheet of material and a second compression block for forming fold lines, where said blocks are alternatingly movable into the position opposite the substrate, the second compression block comprising grooves for the fold lines. Accordingly, the invention makes it now possible to provide different compression blocks for bonding the hot-melt strip on one hand and on the other for forming fold lines, where these blocks optimally match the particular requirements. Thus the first compression block alone may be provided with a heater, and the second compression block may comprise a hard, modeled compression surface.

In a further embodiment of the invention, the bending edge(s) also form(s) a rest for the sheet of material when in the position outside the effective range of the compression block. This means that the bending edge(s) do(es) not move out so much that in its (their) end position it (they) shall be beyond the sheet of material.

The motion of the bending edge(s) when changing position can be selected relatively freely. However an arrangement of the bending edge(s) on one slider fitting is preferred, where this slider is displaceable normally to the motion of the bending edge(s). In this manner the displacement is rectilinear and translatory, and illustratively doubly acting telescoping cylinders may be used for the displacement.

The alignment means for the hot-melt strip appropriately are two guide walls touching the strip's lengthwise sides, at least one guide wall being displaceable relative to the other in order to change their spacing. In this manner the alignment means also can be rapidly matched to the particular width of the hot-melt strip. Advantageously the displaceable guide wall is a movably guided means onto which is mounted the alignment system for the sheet of material. As a consequence, if there is a change in the width of the hot-melt strip, simultaneously the alignment system will be automatically matched to the sheet of material being used. In this embodiment it is further appropriate that the associated bending edge on the guide— where called for together with the telescoping cylinder— be supported in displaceable manner. When the width of the hot-melt strip changes, there will take place also automatic matching with respect to the location of the fold line to that extent, that is, the spacing between the side wall of the hot-melt strip and the fold line remains constant without having to resort to special adjustment steps for that purpose.

Again, a doubly acting telescoping cylinder may be used for the displacement of the guide wall. This cylinder shall be so prestressed in operation that the movable guide wall will be forced in the direction of the opposite guide wall and come to rest against a stop. Special fastening of the movable guide wall is not required in that case. The stop illustratively may be a bracket acting as the substrate for the hot-melt strip.

A further embodiment of the invention provides that suction bores are present in at least one support surface of the apparatus to hold the sheet of material, said bores being connected to a vacuum source. By means of the appropriate vacuum, the sheet of material can be held in place during the compression steps and possibly also during the motion of the bending edge(s).

Lastly the invention provides that the apparatus without the compression block be displaceably supported on a base and in that there be a suction-lift device in the range of motion of the apparatus next to the compression block to lift the sheet of material after the second compression step. By displacing this component of the apparatus underneath the compression block, the sheet of material can be moved into a position below the suction-lift device which then raises it. Following this lift, said component of the apparatus may be moved back. Thereupon the suction-lift device is made inoperative and the sheet of material may drop for instance into a collecting basket wherein the sheets of material are sequentially stapled.

The drawing elucidates the invention by means of an illustrative embodiment. All figures are schematics.

Figure 1:
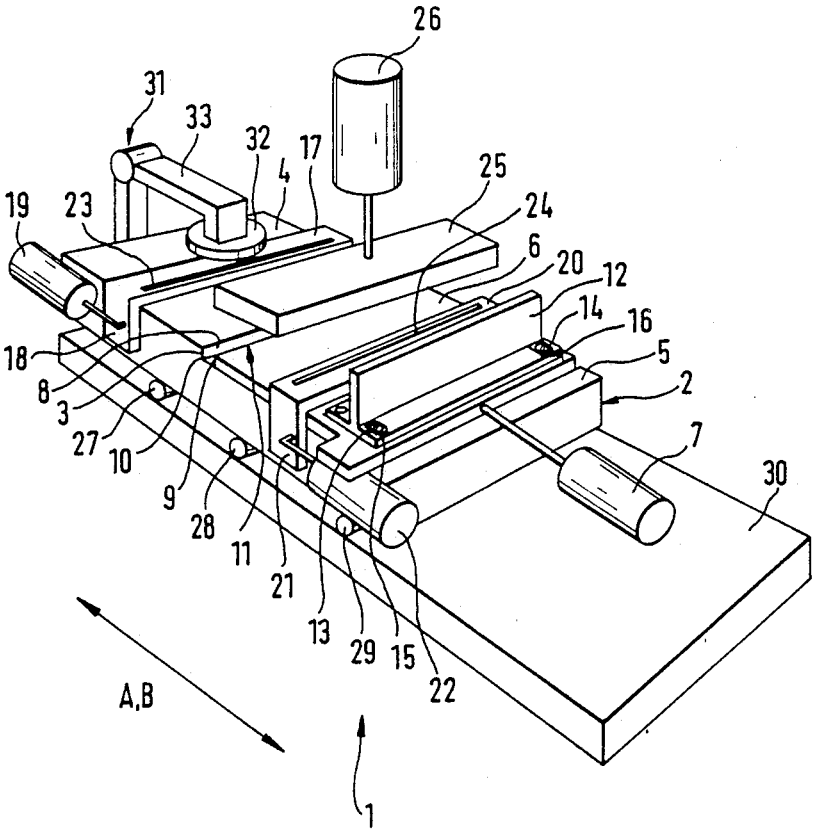
FIG. 1 is a perspective of an apparatus for making book-bindings.
Figure 2:
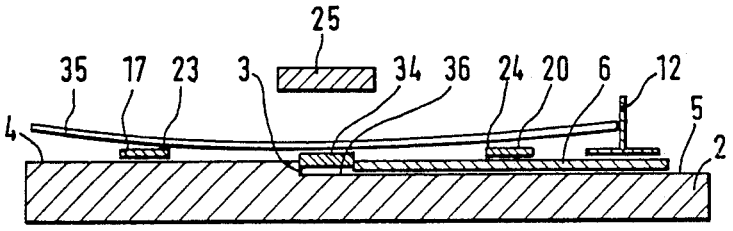
FIG. 2 is a vertical section of the apparatus of FIG. 1 with inserted sheet of material prior to the first compression step, but without guide pin.

The apparatus 1 shown schematically in FIG. 1 comprises a base plate 2 with a shoulder 3 whereby two mutually separate top sides 4, 5 of different heights arise.

A guide plate 6 is displaceably resting in the directions of the double arrow A at the lower top side 5. The displacement is implemented by a dual telescoping cylinder 7 not shown in further detail and linked to the back side of the guide plate 6. The thickness of the guide plate 6 corresponds to the height differential of the two top sides 4, 5.

The shoulder 3 and the opposite end face of the guide plate 6 form guide walls 8, 9 and bound a segment 10 of the lower top side 5, the width of said segment 10 being determined by the particular position of the guide plate 6. The guide walls 8, 9 and the segment 10 form an upwardly open groove 11.

A shaped-section or angle-iron 12 is mounted away from the groove 11 on the guide plate 6. The mounting is by means of two screws 13, 14 seated in elongated slots 15, 16 each extending in the direction of displacement of the guide plate 6. In this manner the angle iron 12 can be adjusted relative to the guide plate 6, i.e., the distance to the groove 11 may be made larger or smaller.

A slider fitting 17 is displaceably supported on the top side 4 of the base plate 2 so as to be movable toward or away from the groove 11. On one side the slider fitting 17 comprises a downward leg 18 connected to a dual telescoping cylinder 19. This telescoping cylinder 19 is fastened to the base plate 2 and can drive the slider fitting 17 to and from in the said directions.

A correspondingly designed slider fitting 20 rests on a guide plate 6 and also can be driven toward or away from the groove 11. The slider fitting 20 also comprises a downward leg 21 linked to another dual acting telescoping cylinder 22. This telescoping cylinder 22 is mounted in a manner not shown here in further detail to the guide plate 6 and upon displacement of latter will move along with it.

Raised bending legs 23, 24 are mounted on the top sides of the slider fittings 17, 20 and extend across the width of latter and are arranged a distance away from the opposite edges of the slider fittings 17, 20.

A compression block 25 stretching across the width of the base plate 2 is present above the groove 11. This block is suspended from a dual acting telescoping cylinder 26 by means of which it can be moved up and down.

The base plate 2 rests by means of rollers 27, 28, 29 on a guide track 30 so as to be displaceable in the directions of the double arrow B. Only the compression block 25 and the telescoping cylinder 26 are stationary. Using a drive omitted from the drawing, the base plate 2 can be driven toward a lift device 31 until its pneumatic suction disk 32 can be lowered by pivoting a suction arm 33 onto a ready sheet of material, then may pick it up and upon retraction of the base plate 2 may deposit the sheet in a collecting basket. As a result, the sheet of material is automatically removed from the apparatus 1.

FIGS. 2 through 5 show how this apparatus 1 operates to make a book-binding.

First a hot-melt strip 34 is placed into the groove 11, that is between the guide walls 8, 9. The depth of groove 11, i.e. the height of the guide walls 8, 9 is such that the hot-melt strip 34 slightly projects from the groove 11 and thus above the plane formed by the top side 4 of the base plate 2 and the top side of the guide plate 6. The slider fittings 17, 20 are located in one of the farthest apart position where they assume the largest distance from the groove 11. A matching sheet of material 35 is placed on the slider fittings 17, 20. The right edge of this sheet of material as seen in this elevation rests against the shaped-section or angle-iron 12. The position of the angle-iron 12 is adjusted in such a way that the area of the sheet of material 35 reserved for the binding back shall be located precisely above the hot-melt strip 34 when the sheet of material 35 rests against the angle iron 12. This is the situation shown in FIG. 2.

Figure 3:
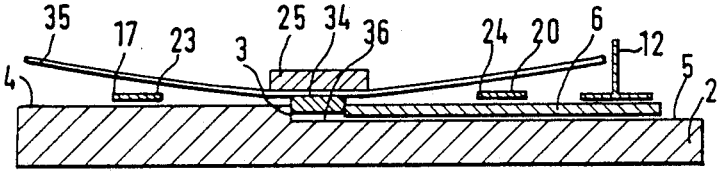
FIG. 3 is a vertical section of FIG. 2 during the first compression step.
Figure 4:
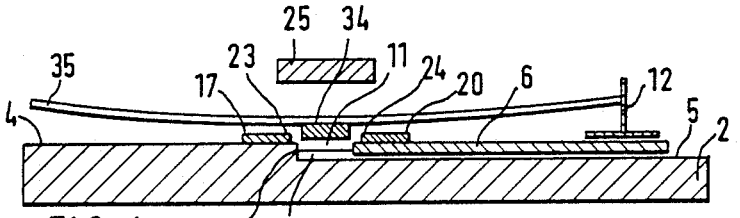
FIG. 4 is a vertical section of FIGS. 2 and 3 during the lifting of the sheet of material.

As shown by FIG. 3, next the compression block 25 is lowered, whereby the sheet of material 35 is pressed in its middle down against the hot-melt strip 34. The compression block 25 being heated, the hot-melt strip 34 is made adhesive by heating it in the vicinity of its resting surface on the sheet of material 35, to which it will then adhere. The pressure to be applied in this first compression step is relatively slight.

Next the compression block 25 is lifted. Simultaneously or immediately thereafter, the slider fittings 17, 20 are synchronously moved toward the groove 11 by means of the corresponding drives of the telescoping cylinders 19, 22.

As a result, the sheet of material 35 is lifted also in the application zone of the compression block 25 and thereby the hot-melt strip 34 is raised off the segment 10. The motion of the slider fittings 17, 20 continues until their raised bending legs 23, 24 assume a position below the fold lines to be formed into the sheet of material 35. Such positions illustratively may be preset by means of stops at the base plate 2 or at the guide plate 6, it being appropriate in this respect that these stops be adjustable in the direction of motion of the slider fittings 17, 20 in order that the distance of the fold lines to the hot-melt strip 34 be freely selectable in the light of the particular requirements.

Figure 5:
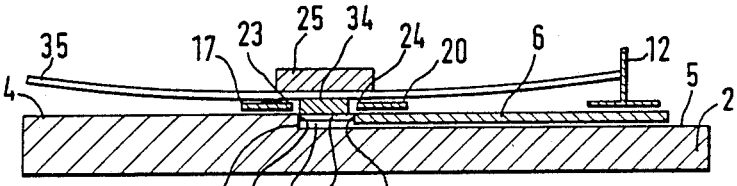
FIG. 5 is a vertical section of FIGS. 2 through 4 during the second compression step.

After the slider fittings 17, 20 have reached their end positions, the compression block 25 is again lowered to carry out the second compression step as shown by FIG. 5. The imparted pressure is substantially higher than in the first compression step, and therefore fold lines are shaped into the sheet of material 35 by the bending legs 23, 24. Then the compression block 25 is raised again and the slider fittings 17, 20 move back to their initial positions shown in FIG. 2. Thereupon the sheet of material 35 is ready to form a book-binding. Next the sheet of material 35 can be removed in problem-free manner from the apparatus 1, and preferably this step shall not be carried out manually but automatically using the lift device 31 shown in FIG. 1 after the base plate 2 has been moved toward this lift device 31. Once the sheet of material 35 has been removed, the base plate 2 is returned to its initial position.

During all these processes, the guide plate 6 is correspondingly pressurized by the telescoping cylinder 7 toward the guide wall 8. A stop in the form of a bar 36 laid in the groove 11 of the segment 10 prevents further nearing of the guide walls 8, 9 and therefore keeps the guide plate 6 a distance from the guide wall 8. The width of the bar 36 essentially corresponds to that particular width of the hot-melt strip 34 used and may be matched to it.

If a hot-melt strip 34 of a different, perhaps bigger width is used, the guide plate 6 is moved back to widen the groove 11 and a correspondingly adjusted bar 36 is inserted in the groove 11 to be a stop for the guide plate 6. Otherwise no changes need to be introduced when the spacing between the fold lines and the side walls of the hot-melt strip 34 are to remain constant. By moving back the guide plate 6, the relative position of the slider fitting 20 and of the angle iron 12 also shall change because both are linked to the guide plate 6. Therefore the apparatus 1 may be matched very simply and rapidly to variously wide hot-melt strips 34 and to correspondingly adjusted formats of the sheet of material 35.

I claim:

1. A method for making book-bindings from a sheet of material and a strip of hot-melt adhesive, including the steps of:

(a) initially aligning a hot-melt adhesive strip on a base;

(b) aligning a sheet of material relative to the hot melt adhesive strip;

(c) pressing a first time the sheet of material onto the strip of hot-melt adhesive for bonding the strip of hot-melt adhesive to the sheet of material without forming folding lines therein;

(d) pressing a second time the sheet of material against at least one associated bending edge adjacent at least one longitudinal side of the hot-melt adhesive strip thereby forming at least one folding line in the sheet of material;

(e) maintaining the sheet of material in the initially aligned position during said first and second pressing steps; and (f) lifting the sheet of material following said first pressing step and prior to said second pressing step by moving the at least one associated bending edge to a position below an anticipated position of the at least one fold line thereby lifting the hot-melt adhesive off the base.

2. A method of claim 1, including the further step of:

(a) maintaining the at least one associated bending edge outside an effective compression range for supporting the sheet of material until said lifting step.

3. A method of claim 1, including the further step of:

(a) controlling the pressing force exerted in said first and second pressing steps such that a lesser pressure is exerted on the sheet of material in said first pressing step than in said second pressing step.

4. An apparatus for making book-bindings from a sheet of material and from a strip of hot-melt adhesive, comprising:

(a) a base having a first alignment means for aligning a hot-melt adhesive strip;

(b) a second alignment means for aligning a sheet of material relative to said base;

(c) at least one bending edge for forming at least one fold line in the sheet of material along the hot-melt adhesive strip;

(d) a compression block means for pressing the sheet of material on said base, said compression block means being positioned opposite said base, wherein said at least one bending edge is structured to be moved out of the effective range of said compression block means to allow bonding of the hot-melt strip to the sheet of material and to be moved from the position outside the effective range of the compression block means into a position below an anticipated fold line to allow the forming of at least one fold line, and said at least one bending edge having a height such that the sheet of material is lifted jointly with the hot-melt adhesive strip upon displacement of the at least one bending edge into the effective range of said compression block means.

5. An apparatus as in claim 4, further including:

(a) control means for lowering the pressure when bonding the hot-melt adhesive strip to the sheet of material and increasing the pressure when forming at least one fold line therein.

6. An apparatus as in claim 4, further including:

(a) first compression block means for bonding the hot-melt adhesive strip to the sheet of material; and (b) a second compression block means having at least one groove formed therein for forming the at least one fold line, wherein said first and second compression block means are structured to be alternatively positioned opposite the base.

7. An apparatus as in claim 4, wherein:

(a) only said first compression block means includes a heating means for bonding the hot-melt adhesive strip to the sheet of material.

8. An apparatus as in claim 4, wherein:

(a) said at least one bending edge includes rest means for supporting the sheet of material when positioned outside an effective compression range.

9. An apparatus as in claim 4, wherein:

(a) said at least one bending edge is mounted on a slider fitting, said slider fitting is structured to move perpendicular to the direction of extension of said at least one bending edge.

10. An apparatus as in claim 4, further including:

(a) at least one dual-acting telescoping cylinder means for driving said at least one bending edge.

11. An apparatus as in claim 4, wherein:

(a) said first aligning means includes two guide walls means for supporting the hot-melt adhesive strip along longitudinal sides thereof, at least one of said guide wall means is structured to move relative to the other to adjust spacing therebetween.

12. An apparatus as in claim 11, further including:

(a) a guide member having said at least one moveable guide wall means and said second aligning means mounted thereon.

13. An apparatus as in claim 12, wherein:

(a) said at least one bending edge is displaceably supported on said guide member and operably associated with said at least one dual acting telescoping cylinder.

14. An apparatus as in claim 11, further including:

(a) a telescoping cylinder for displacing said at least one moveable guide wall means.

15. An apparatus as in claim 14, further including:

(a) a stop means operably associated with said telescoping cylinder, said telescoping cylinder being structured to displace said at least one moveable guide wall means relative to the other guide wall means and position said at least one moveable guide wall means in abutting contact with said stop means.

16. An apparatus as in claim 15, wherein:

(a) said stop means is a bar having substantially the same dimensions as the hot-melt adhesive strip.

17. An apparatus as in claim 4, wherein:

(a) said base includes at least one suction borehole means for holding the sheet of material thereto, said suction borehole is structured to be operably associated with a vacuum source.

18. An apparatus as in claim 4, further including:

(a) a suction lift means operably associated with said base for lifting the sheet of material after at least one fold line is formed therein.

* * * * *